US005243396A

United States Patent [19]

Castelli et al.

[11] Patent Number: 5,243,396

[45] Date of Patent: Sep. 7, 1993

[54] DESIGN RULES FOR IMAGE FORMING DEVICES TO PREVENT IMAGE DISTORTION AND MISREGISTRATION

[75] Inventors: Vittorio Castelli, Yorktown Heights, N.Y.; Harold M. Anderson, Rancho Palos Verdes, Calif.

[73] Assignee: Xerox Corporation, Stamford, Conn.

[21] Appl. No.: 900,950

[22] Filed: Jun. 17, 1992

[51] Int. Cl.[5] ..... G03G 15/01

[52] U.S. Cl. ..... 355/327; 355/200; 355/211; 355/275

[58] Field of Search ..... 355/200, 211, 212, 271, 355/272, 326, 327, 275; 474/69, 84–86; 346/157, 160

[56] References Cited

U.S. PATENT DOCUMENTS

| | | | |
|---|---|---|---|
| 3,853,397 | 12/1974 | Cantarano | 355/265 |
| 4,179,210 | 12/1979 | Bestenreiner et al. | 355/261 X |
| 4,478,510 | 10/1984 | Fujii et al. | 355/296 X |
| 4,480,907 | 11/1984 | Vackier | 355/261 X |
| 4,491,855 | 1/1985 | Fujii et al. | 346/159 |
| 4,531,828 | 7/1985 | Hoshino | 355/272 |
| 4,610,531 | 9/1986 | Hayashi et al. | 355/265 X |
| 4,690,542 | 9/1987 | Furuta et al. | 355/327 |
| 4,788,574 | 11/1988 | Matsumoto et al. | 355/326 |
| 4,796,050 | 1/1989 | Furuta et al. | 355/327 X |
| 4,803,515 | 2/1989 | Hoshino et al. | 355/271 |
| 4,868,600 | 9/1989 | Hays et al. | 355/265 X |
| 4,899,196 | 2/1990 | Mahoney | 355/271 |
| 5,111,242 | 5/1992 | Tanimoto et al. | 355/200 |

FOREIGN PATENT DOCUMENTS

| | | |
|---|---|---|
| 0129873 | 6/1987 | Japan . |
| 0052175 | 2/1989 | Japan . |
| 0250077 | 10/1990 | Japan . |

*Primary Examiner*—A. T. Grimley
*Assistant Examiner*—Robert Beatty
*Attorney, Agent, or Firm*—Oliff & Berridge

[57] ABSTRACT

The present invention relates to design rules and geometric compensations for image forming devices. The inherent eccentricities of the photosensitive belts or drums and the timing belt speed reduction drive trains of image forming device cause misregistration of the developed latent images. To prevent such misregistration, the timing belt of the speed reduction drive train has a peripheral length which is selected from a range of values dependent on a preselected speed reduction ratio between the driven pulley and the driving pulley. Further, each one of the range of values is an integral improper fraction or integral multiple of the circumference of the driven pulley. Moreover, the driving pulley of the last pulley belt set coupled to the photosensitive member and a driven pulley prior to the last pulley belt set rotate n full rotations as the photosensitive member rotates from the image forming location to the image transfer location. In conjunction, every speed reduction ratio of all pulley belt sets prior to the last pulley belt set is an integer value. Thus, the eccentricities will be self-compensated.

3 Claims, 3 Drawing Sheets

DESIGN RULES FOR IMAGE FORMING DEVICES TO PREVENT IMAGE DISTORTION AND MISREGISTRATION

BACKGROUND OF THE INVENTION

1. Field of the Invention

The present invention is directed to image forming devices, such as electrostatic copying machines, and in particular to design rules and geometric compensations for image forming devices which prevent misregistration of developed latent images. Such misregistrations arise due to inherent eccentricities in the photoreceptors or the speed reduction drive trains of the image forming devices.

2. Discussion of the Related Art

U.S. Pat. No. 4,531,828 to Hoshino discloses an imaging apparatus which prevents misregistration by designing the driving roller of the screen belt to have a peripheral length equal to an integer multiple of the spacing between the respective transfer stations. As shown in FIG. 1, apparatus 1 comprises four sets of electrophotographic laser beam printer mechanisms I-IV which are substantially identical in construction. Each printer mechanism comprises a photosensitive drum 10 mounted on a rotatable shaft 12, a charging a cleaning device 14, a transfer discharger 16 and a developing device 22.

A laser beam scanner 20 oscillates a laser beam L along the surface of a photosensitive drum 10, which rotates about a shaft 12, and forms a latent image corresponding to an electrical or optical input. Developing devices 22 of printer mechanisms I-IV develop the latent images using yellow (Y), magenta (M), cyan (C), and black (BK) developing toners. Driving rollers 24 and 26 with a diameter D rotate a screen belt 28 to convey a sheet of paper P through transfer stations of printer mechanisms I-IV. The developed image of each printer mechanism is transferred onto the paper to form a multiplexed color image.

Because the driving roller 26 has an inherent eccentricity, resulting from its manufacture or assembly, the peripheral speed of roller 26 will vary from high to low speeds at various angular positions as the screen belt 28 moves past and contacts the roller 26. Thus, the speed imparted to the screen belt 28 is not constant, but rather varies in a sine-wave like fashion. The varying speed imparted to the screen belt 28 causes misregistration of one developed image transferred from one printer mechanism with respect to the other developed images transferred from the other printer mechanism. The misregistration of the developed images causes distortions of the color image on the paper P.

To prevent such misregistration from occurring, the driving roller 26 is designed so that its peripheral length or circumference is equal to be an integer multiple of the spacing H between the respective transfer stations (i.e., the distance travelled by the screen belt between the respective transfer stations, or the image pitch length). Further, the drive roller 26 is driven by a gear train comprised of a combination of forty teeth to twenty teeth so as to provide a reduction gear ratio of 2:1. Thus, even if the gears have inherent eccentricities, the phase angle of the eccentricity of each gear varies identically as the paper passes through each transfer station. Therefore, misregistration is prevented.

U.S. Pat. No. 4,803,515 to Hoshino et al. discloses another source of misregistration caused by an inherent drive non-uniformity of the driving means of the photosensitive drum 10, as shown in FIG. 2. The driving means comprise an electric motor 30, a driving gear 32 and a driver gear 34 and the non-uniformity of the driving means results in the non-uniform rotational speed of photosensitive drum 10. The non-uniform speed of the photosensitive drum 10 expands or shrinks the latent image when the laser beam 20 writes the latent image on the photosensitive drum surface during image exposure steps. As a result, the developed image transferred onto the paper P is expanded or shrunk correspondingly.

In order to solve the problem of the image expansion and shrinkage attributable to the non-uniform drive by the driving means, the photosensitive drum 10 is driven in such a controlled manner that the time required for the photosensitive drum surface to move from an image writing position 10*a* (latent image forming position) to an image transfer position 10*b* is an integer multiple of the period of the drive non-uniformity of the photosensitive drum driving means. In other words, the rotational period T1 of a gear 32 is an integral fraction of the time interval T2 of the movement of writing position 10*a* to transfer position 10*b*. Because of this arrangement, an integrated pitch error (per one full turn) and an adjacent pitch error (per one tooth), attributable to the gear 32 at the time of image writing, are reproduced at the time of image transfer.

Both of the above patents use a gear train to rotate the roller or the photosensitive drum. A more efficient method of speed reduction is the use of a timing belt speed reduction drive train having two sets of pulleys and timing belts. The timing belt speed reduction drive train is driven by a small, high speed, low torque motor which is less expensive and thus reduces the cost of the image forming device. Further, because the timing belt speed reduction drive train includes numerous pulleys and timing belts, the design criteria of a gear system cannot solve the harmonic motion errors caused by eccentricities in the pulleys and belts. Neither of the above patents discloses design rules to reduce harmonic motion errors caused by eccentricities in the pulleys and the belts.

Further, photosensitive belts can be used for the image forming device rather than photosensitive drums. Neither of the above patents discloses geometric compensations to eliminate registration errors that might otherwise result from harmonic errors (odd or even) in the motion of the photosensitive belts. Moreover, neither of the above U.S. patents discloses photosensitive belts having dimensions which may be chosen independent from the image pitch length.

All references cited in the specification, and their references, are incorporated by reference herein where appropriate for appropriate teachings of additional or alternative details, features, and/or technical background.

SUMMARY OF THE INVENTION

It is an object of the present invention to provide an image forming device having an improved timing belt speed reduction drive train.

It is another object of the present invention to provide design rules for the pulleys and belts of the timing belt speed reduction drive train to reduce harmonic motion errors caused by eccentricities in the pulleys and belts.

It is a further object of the present invention to provide an image forming device having improved photoreceptors.

It is a further object of the present invention to provide geometric compensations for photoreceptor to reduce harmonic motion errors caused by eccentricities in the turnaround rollers of the photoreceptors.

It is an object of the present invention to reduce the cost of an image forming device.

To achieve the foregoing and other objects and advantages, and to overcome the shortcomings discussed above, the driving system of the image forming device adhere to certain design rules and geometric relationship with other components in the drive system to prevent the misregistration of the developed latent image onto a transfer medium. Preferably, the driving system is a timing belt speed reduction drive train for rotating each one of a plurality of rotatable photosensitive members from an image forming location to an image transfer location. The preferred embodiment of the timing belt speed reduction drive train comprises two sets of pulley belt sets, and each pulley belt set comprises a driving pulley, a driven pulley and a timing belt wrapped around the driving and driven pulleys.

The timing belt of the timing belt speed reduction drive train has a peripheral length which is selected from a range of values dependent on a selected speed reduction ratio between the driven pulley and the driving pulley. Further, each one of the range of values is an integral improper fraction or integral multiple of the circumference of the driven pulley. Moreover, the driving pulley of the last pulley belt set coupled to the photosensitive member and a driven pulley prior to the last pulley belt set rotate n full rotations as the photosensitive member rotates from the image forming location to the image transfer location. In conjunction, every speed reduction ratio of all pulley belt sets prior to the last pulley belt set is an integer value. Thus, the eccentricities of the driving system will be self-compensated.

The present invention is also applicable to any type of driving system employing pulley and belt to rotate or to move in a linear direction a particular component within an apparatus. Further, if the geometric design rules and compensation relationships are followed, motor cogging motion disturbances are also self-compensated for image forming devices utilizing drum tandem architecture or belt-on-belt (pentabelt) architecture.

BRIEF DESCRIPTION OF THE DRAWINGS

The invention will be described in detail with reference to the following drawings in which like reference numerals refer to like elements wherein.

DETAILED DESCRIPTION OF THE PREFERRED EMBODIMENTS

Figure 3:
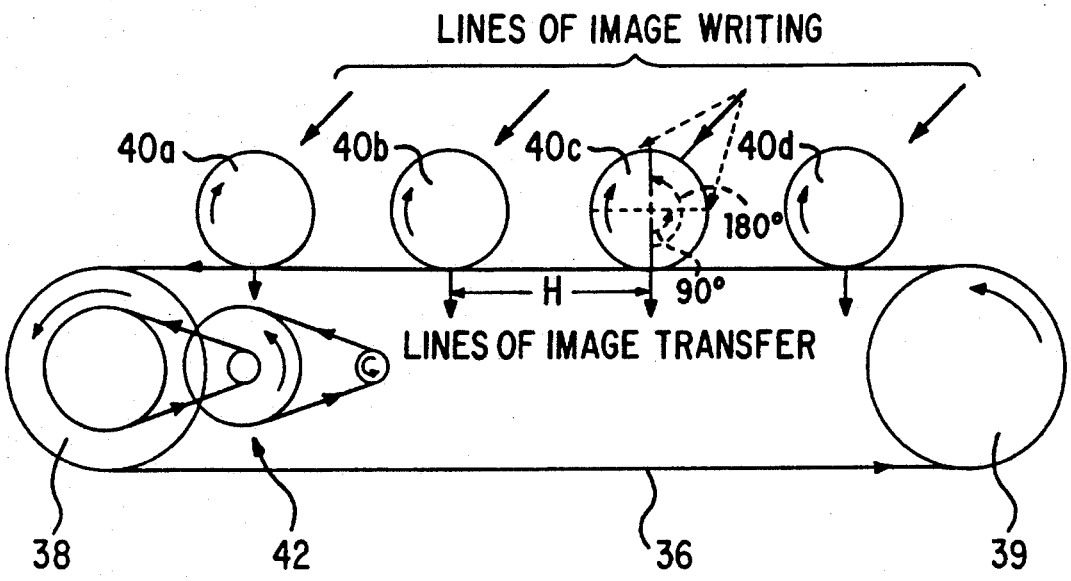
FIG. 3 illustrates an image forming device in accordance with the present invention.

Xerographic process typically includes erasure, precharging, writing of the latent image, development of the latent image with toners, and the transfer of the image to a sheet or an intermediate belt (hereinafter referred to as a second medium 36). As shown in FIG. 3, for each of the photosensitive drums 40*a–d*, the image writing location is generally 90° to 180° of drum rotation upstream from the image transfer location. The image transfer location occurs where the photosensitive drum contacts the second medium 36 to transfer the developed latent image onto the second medium 36.

Figure 1:
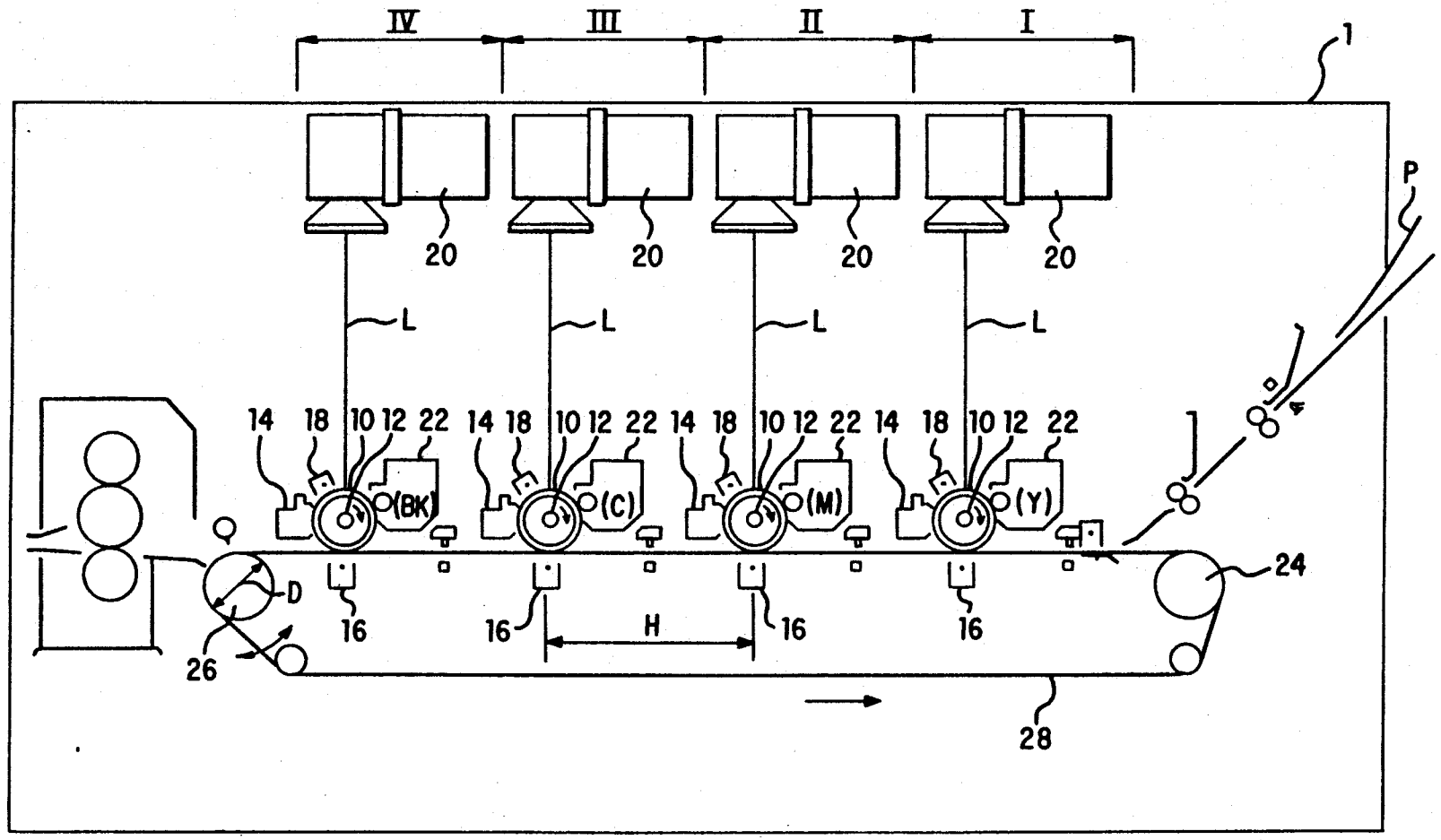
FIG. 1 PRIOR ART
FIG. 1 illustrates a conventional imaging apparatus.
Figure 4:
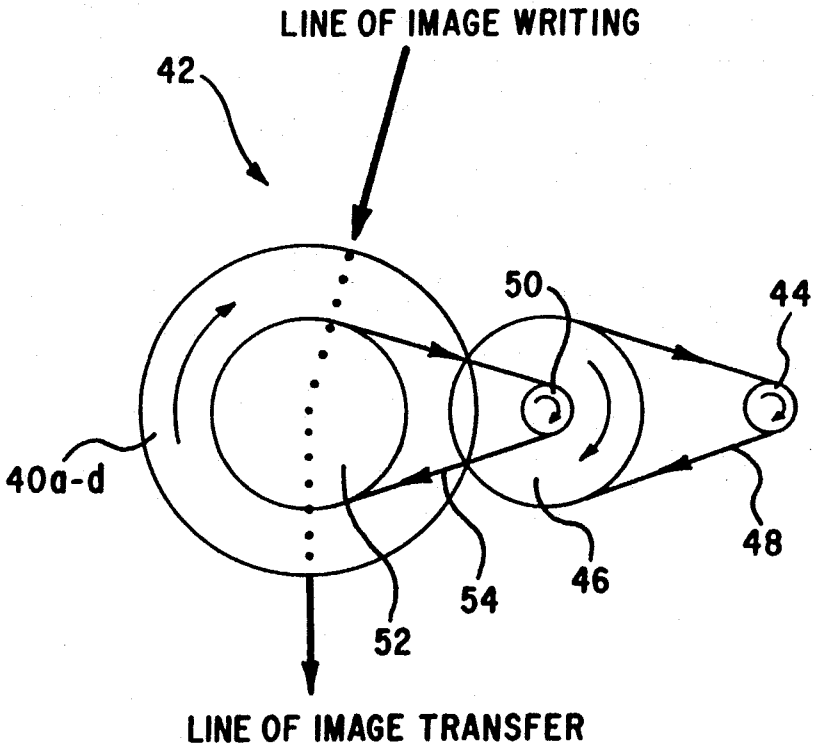
FIG. 4 illustrates a timing belt speed reduction drive train.
Figure 2:
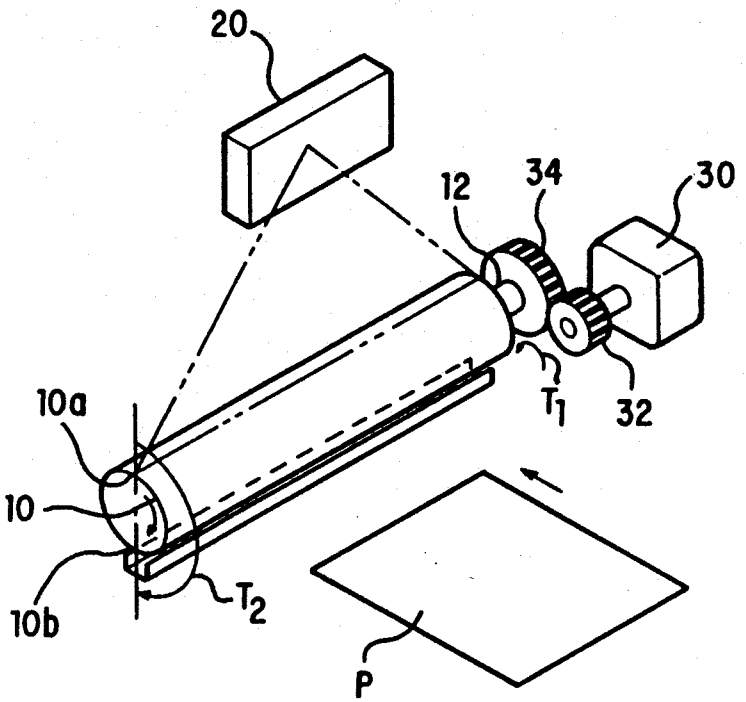
FIG. 2 PRIOR ART
FIG. 2 illustrates a photosensitive drum of the conventional imaging apparatus.

In the apparatus of the present invention, each of the photosensitive drums 40*a–d* is driven by an independent timing belt speed reduction drive train 42 as shown in FIG. 4. Each timing belt speed reduction train 42 comprises at least one set of pulleys and timing belts. In the preferred embodiment shown in FIGS. 3–5, there are exactly two sets of pulleys and timing belts. However, it can be appreciated that one, three or more sets of pulleys and belts can be used. In the preferred embodiment shown in FIG. 4, the first driving pulley 44 is driven by a small, high speed, low torque motor (not shown) and is coupled to a first driven pulley 46 by a first timing belt 48 to form a first pulley belt set. A second driving pulley 50 and a second driven pulley 52 are interconnected by a second timing belt 54 to form a second pulley belt set. First driven pulley 46 and second driving pulley 50 are connected to and synchronously rotate about a first shaft, while the photosensitive drum and second driven pulley 52 are connected to and synchronously rotate about a second shaft. The velocity imparted to the photosensitive drum by the drive train 42 is imperfect because of eccentricities in the pulleys and the timing belts. These eccentricities lead to harmonic errors in the velocity of the drums and distortions in the image transfer to the second medium 36.

The timing belt speed reduction drive train 42 is used in conjunction with a servo (not shown) that employs a feedback from a well-centered shaft-angle encoder (not shown) on the second shaft. The servo is effective in correcting low frequency disturbances such as those caused by eccentricities in the second driven pulley 52 and the second timing belt 54, but the servo is less effective in correcting higher frequency disturbances caused by eccentricities in the first driving and driven pulleys 44 and 46, the second driving pulley 50 and the first timing belt 48.

Further, the harmonic distortion in the image formed on the drum is aggravated or attenuated depending upon the relationship between the line of image writing and the wavelength of the harmonic disturbance. For example, if the time for the photosensitive drum to rotate from the line of image writing to the line of image transfer is substantially equal to an odd integer number of half-wavelengths of the harmonic disturbance, the photosensitive drum rotates at its maximum high speed when writing onto the photosensitive drum and its maximum low speed when transferring the image to the second medium 36. Thus, the positional harmonic disturbance in the transferred image will be substantially doubled.

To prevent the misregistration, of the developed image, the speed disturbance of the photosensitive drum at the instant of image transfer must equal the speed disturbance of the photosensitive drum at the line of image writing for each of the photosensitive drums. If the time for the photosensitive drum to rotate from the line of image writing to the line of image transfer is exactly equal to an integer number of full wavelengths of the harmonic disturbance, the speed of the photosensitive drum will be the same when the image is transferred as when the image was written. Thus, there is no distortion in the transferred image. However, this assumes that the transit time of the image through the image transfer zone is short relative to the period of the harmonic disturbance.

To achieve such a design rule, the first driven pulley 46 and the second driving pulley 50 must rotate an integer number of times while the photosensitive drum progresses from the line of imaging to the line of transfer. For example, if the line of image writing is 160° upstream from the line of image transfer, the ratio of one full rotation of the first driven pulley 46 and the second driving pulley 50 to the rotation from the line of image writing to the line of image transfer is equal to 360°/160° or 2.25.

Further, in order to geometrically compensate for the eccentricities of the first timing belt 48, the first timing belt 48 should rotate an integer number of times as the photosensitive drum progresses from the line of writing to the line of image transfer and as the first driven pulley 46 and the second driving pulley 50 rotate an integer number of times. If the first timing belt 48 rotates an integer number of times, the eccentricity of the first timing belt will be self-compensated.

Thus, if any prior speed reduction prior to the last pulley belt set is equal to an integer value, a speed reduction of $2.25 \times n$, where n is any positive integer, will cause the first driving pulley 44, the first driven pulley 46 and the second driving pulley 50 in the reduction train to rotate an integer number of times while the photosensitive drum progresses from the line of imaging to the line of image transfer.

A comprehensive design rule for self compensation of harmonic disturbances in a timing belt speed reduction drive train can be stated as follows:

$$s=(360/\theta)\pm n, \text{ and} \quad (1)$$

$$L(n,i(n)) = \frac{nC}{n-i} \quad (2)$$

where, s is the speed reduction ratio of the last pulley belt set (i.e., closest to the photosensitive drum);

$\theta$ equals the angular upstream displacement around the periphery of the photosensitive drum from the line of image transfer to the line of image writing;

n is any positive integer;

L equals the length of the timing belt of the pulley belt set prior to the last pulley belt set;

C equals the circumference of the driven pulley of the pulley belt set prior to the last pulley belt set;

i equals 0, 1, . . . , n−1; and any prior speed reduction prior to the last pulley belt set should be made equal to an integer value.

In equations (1) and (2), n is any positive integer multiple of the ratio of one rotation of the driving pulley of the last pulley belt set (which is connected to the driven pulley of the pulley belt set prior to the last pulley belt set) to $\theta$ rotation of the photosensitive drum. Thus, for every $\theta$ rotation of the drum, the driving pulley of the last pulley belt set and the driven pulley of the pulley belt set prior to the last pulley belt set will rotate n full rotations. Further, because i has a range of values dependent upon n in equation (2), L(n,i(n)) is a family of solutions for which all harmonic errors of the timing belt prior to the last pulley belt set are self-cancelling. The timing belt prior to the last pulley belt set will rotate an integer number of times as the photosensitive drum rotates from the imaging location to the transfer location ($\theta$ rotation) and as the driven pulley prior to the last pulley belt set rotates n full rotations.

Examples of various solutions for L is shown below as the value of n increases.

For n=1; i=0; and L(1,0)=C.

For n=2; i=0 and 1; and L(2,0)=C and L(2,1)=2C/1

For n=3; i=0, 1, and 2; and L(3,0)=C, L(3,1)=3C/1, and L(3,2)=3C/2.

In L(3,1), for each $\theta$ rotation of the photosensitive drum, the pulleys, i.e., the driving pulley of the last pulley belt set and the driven pulley of the pulley belt set prior to the last pulley belt set, rotate 3 times and the timing belt prior to the last pulley belt set rotates once.

In L(3,2), for each $\theta$ rotation of the photosensitive drum, the pulleys rotate 3 times and the timing belt prior to the last pulley belt set rotates twice.

For n=4; i=0, 1, 2, or 3; and L(4,0)=C, L(4,1)=4C/3, L(4,2)=4C/2=2C, and L(4,3)=4C/1. . . . and so on.

Every even n will have 2C as one of its solutions and the number of possible solutions for L(n,i) equals n. However, in the preferred embodiment, the values of L(n,i) chosen should be between 2C and the shortest solution which will give a belt length L long enough to wrap around the driving and driven pulleys. Preferably, the value of L(n,i) should be chosen to provide the shortest distance between the driving and driven pulleys. Moreover, because the pulleys are belt driven, L(n,0) should not be chosen for the peripheral length of the timing belt for whatever value of n.

For example, in FIG. 4, if $\theta=160°$, n=2, i=1 and the speed reduction of the first pulley belt set equals 3, the first driven pulley 46 and the second driving pulley 50 rotate exactly twice, the first timing belt 48 rotates exactly once because the length of the first timing belt 48 is 2C, and the first driving pulley 44 rotates exactly six times as the photosensitive drum progresses from the line of imaging to the line of image transfer. All of the eccentricities will be self-compensated except for the second driven pulley 52 and the second timing belt 54. The servo compensates for the eccentricities in the second driven pulley 52 and the second timing belt 54.

If the above design rules and geometric compensations are followed, the harmonic disturbances of the photosensitive drums caused by the eccentricities of all of the pulleys and the timing belts, except for the last driven pulley and the last timing belt, will be self-compensated during the image transfer process. The servo will compensate for the eccentricities of the last driven pulley and the last timing belt.

FIG. 3 also illustrates the timing belt speed reduction drive train for the second medium 36 which is wrapped around a driven roller 38 and a guide roller 39. As described above, the circumference of a driven roller 38 which moves and guides the second medium 36 should be equal to an integer fraction of the image pitch length H. Because the circumference of the driven roller equals an integer fraction of the image pitch length, the driven roller 38 rotates an integral number of times and $\theta$ equals 360°. If such initial conditions are applied to the design rules of the present invention, a design rule for the timing belt speed reduction drive train 42 of the second medium 36 is as follows: $s=(360/360)\times n = n$.

Thus, the speed reduction of the last pulley belt set equals any positive integer, any speed reduction prior to the last pulley belt set should be made equal to an integer value, and the timing belt of the pulley belt set prior to the last pulley belt set should have its peripheral length equal to an integral improper fraction, e.g., 3/2, 4/3, 5/2, etc., or integral multiple, e.g., 2, 3, 4, etc., of the circumference of the driven pulley.

Figure 5:
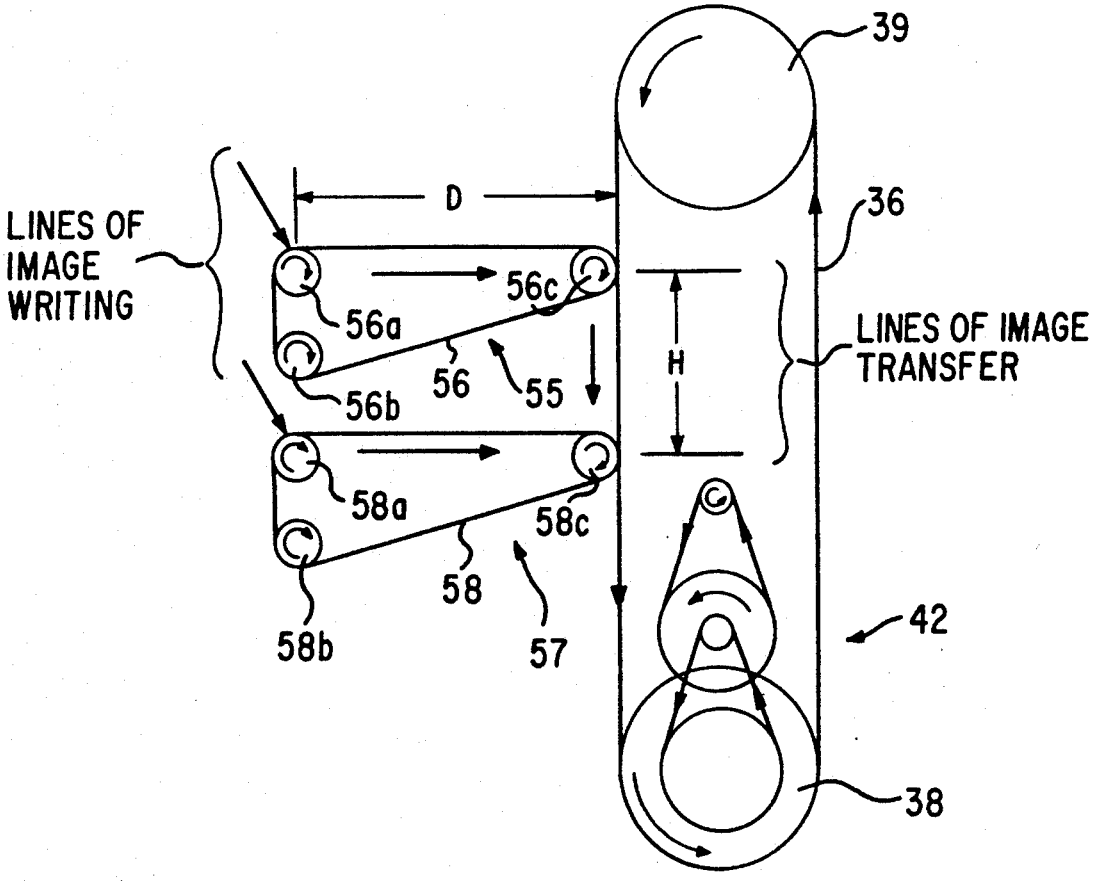
FIG. 5 illustrates an image forming device employing photoreceptors in accordance with an alternative embodiment of the present invention.

FIG. 5 discloses an alternative embodiment of the image forming device. The image forming device in accordance with the second embodiment of present invention uses photoreceptors 55 and 57 having photosensitive belts 56 and 58 wrapped around a plurality of turnaround rollers 56*a–c* and 58*a–c*, respectively. A timing belt speed reduction drive train rotates one of the turnaround rollers in each photoreceptor to circulate the photosensitive belt and the remaining turnaround rollers guide the photosensitive belt. The photoreceptors offer the designer the following design freedoms: (1) the circumferences of the turnaround rollers 56*a–c* and 58*a–c* may be chosen without regard to the image pitch length; (2) the turnaround rollers in each of the photoreceptors may have different circumferences; and (3) there is no substantive restriction on the distance D from the line of image writing to the line of image transfer.

As in the previous embodiment, the photosensitive belt 36 is wrapped around a driven roller 38 an a guide roller 39 and the circumference of the driven roller 38 is an integral fraction of the image pitch length H. Further, the eccentricities of the turnaround rollers 56*a–c* and 58*a–c* cause harmonic disturbances in the motion of the photosensitive belts 56 and 58. The harmonic disturbances of each photosensitive belt cause registration errors between the developed images of the photoreceptors 55 and 57.

To prevent the registration errors, the circumference of each turnaround roller 56*a–c* and 58*a–c* is an integer fraction of the distance between the line of image writing and the line of image transfer. In other words, the distance D is equal to an integer multiple of the circumference of each turnaround roller. Such geometric design approach virtually eliminates registration errors that might result from harmonic errors (odd or even) in the motion of the photosensitive belts.

Further, the timing belt speed reduction drive train used to drive the driven turnaround roller follows the same design rules of the timing belt speed reduction drive train of the second medium 36. Moreover, the photosensitive belt has an added advantage that the final speed reduction need not be related to any physical characteristics of the apparatus, as in the drum photoreceptor embodiment. For example, if the circumferences of all of the rollers are equal to two inches, and the distance along the belt from the line of image writing to the line of image transfer is 10 inches, a speed reduction of 2.5:1 would accomplish the desired cancellation of the harmonic disturbances.

With the above design rules and geometric compensation, the registration errors are virtually eliminated. However, the foregoing embodiments are intended to be illustrative and not limiting. Many more pulley belt sets may be employed to form the timing belt speed reduction drive train as long as the above design rules and geometric compensations are adhered to. Further, many more photoreceptors may be used to form the image forming device. Thus, various modifications may be made without departing from the spirit and scope of the present invention as defined in the appended claims.

What is claimed is:

1. An image forming device comprising:

a plurality of rotatable photosensitive drums;

means for writing a latent image on each of said plurality of rotatable photosensitive drums at an image forming location;

means for developing said latent image into a developed image;

transferring means for transferring said developed image of each of said plurality of rotatable photosensitive drums into a medium at an image transfer location; and a timing belt speed reduction drive train for rotating each one of said plurality of rotatable photosensitive drums $\theta$ degrees from said image forming location to said image transfer location, said timing belt speed reduction drive train comprising first and second pulley belt sets, each pulley belt set having a driven pulley, a driving pulley, and a timing belt wrapped around said driven and driving pulleys, said second pulley belt set having a speed reduction ratio s equal to $360n/\theta$ wherein n is a positive integer representing the number of rotations of said second driving pulley per $\theta$ degrees rotation of each of said photosensitive drums, a preselected speed reduction ration between said first driven pulley and said first driving pulley being equal to an integer value, said first timing belt having a peripheral length which is an integral improper fraction or integral multiple of a circumference of said first driven pulley.

2. An image forming device comprising:

a plurality of rotatable photoreceptors, each photoreceptor comprising:

a plurality of turnaround rollers, one of said plurality of turnaround rollers being driven by a timing belt speed reduction drive train and each turnaround roller having a predetermined circumference; and a photosensitive belt wrapped around said plurality of turnaround rollers;

means for writing a latent image on each of said plurality of rotatable photoreceptors at an image forming location;

means for developing said latent image into a developed image; and transferring means for transferring said developed image of each said plurality of rotatable photoreceptors onto a medium at an image transfer location;

wherein each predetermined circumference of said turnaround rollers is an integer fraction of a distance between said image writing location and said image transfer location, said timing belt speed reduction drive train for driving said one of said plurality of turnaround rollers comprising first and second pulley belt sets, each pulley belt set having a driven pulley, a driving pulley, and a timing belt wrapped around said driven and driving pulleys, said second pulley belt set having a speed reduction ration s equal to a positive integer n, a preselected speed reduction ratio between said first driven pulley and said first driving pulley being equal to an integer value, said first timing belt having a peripheral length which is an integral improper fraction or integral multiple of a circumference of said first driven pulley.

3. An image forming device comprising:

a plurality of rotatable photosensitive members;

means for writing a latent image on each of said plurality of rotatable photosensitive members at an image forming location;

means for developing said latent image into a developed image; and transferring means for transferring said developed image of each of said plurality of rotatable photosensitive members onto a medium at an image transfer location, wherein said transferring means comprises:

a plurality of rollers;

a belt wrapped round said plurality of rollers, said belt being in contact with each one of said plurality of rotatable photosensitive members at said image transfer location; and a timing belt speed reduction drive train for rotating said belt, said timing belt speed reduction drive train comprising first and second pulley belt sets, each pulley belt set having a driven pulley, a driving pulley, and a timing belt wrapped around said driven and driving pulleys, said second pulley belt set having a speed reduction ratio s equal to a positive integer n, a preselected speed reduction ration between said first driven pulley and said first driving pulley being equal to an integer value, said first timing belt having a peripheral length which is an integral improper fraction or integral multiple of a circumference of said first driven pulley.

* * * * *